US006068083A

United States Patent [19]

Takahashi

[11] Patent Number: 6,068,083

[45] **Date of Patent: *May 30, 2000**

[54] FOOTHOLD

[75] Inventor: Eizo Takahashi, Soka, Japan

[73] Assignee: Miyama Kogyo Kabushiki Kaisha, Saitama-ken, Japan

[ * ] Notice: This patent is subject to a terminal disclaimer.

[21] Appl. No.: 09/272,266

[22] Filed: Mar. 19, 1999

[51] Int. Cl.[7] ..... E06C 7/08

[52] U.S. Cl. ..... 182/92; 182/90

[58] Field of Search ..... 182/90, 92

[56] References Cited

U.S. PATENT DOCUMENTS

| | | |
|---|---|---|
| 601,849 | 4/1898 | Aiken . |
| 2,064,803 | 12/1936 | Grove . |
| 4,100,997 | 7/1978 | Peacock . |
| 4,241,543 | 12/1980 | Foscarini et al. . |
| 4,610,330 | 9/1986 | Borst . |
| 4,655,318 | 4/1987 | Bowen . |
| 4,660,681 | 4/1987 | Zenhausern . |
| 4,702,349 | 10/1987 | Zenhausern . |
| 4,771,861 | 9/1988 | Zenhausern et al. . |
| 4,778,032 | 10/1988 | Takahashi . |
| 4,869,342 | 9/1989 | Borst . |
| 5,752,579 | 5/1998 | Takahashi . |
| 5,772,358 | 6/1998 | Takahashi . |

FOREIGN PATENT DOCUMENTS

| | | |
|---|---|---|
| 173 227A | 3/1986 | European Pat. Off. . |
| 4-4040 | 6/1992 | Japan . |
| 6-71899 | 7/1994 | Japan . |
| 2700618 | 3/1997 | Japan . |
| 10-292412 | 4/1997 | Japan . |
| 28 19106 | 7/1997 | Japan . |
| 09195295 | 7/1997 | Japan . |
| 10292412 | 11/1998 | Japan . |
| 470 919 | 8/1937 | United Kingdom . |

*Primary Examiner*—Alvin Chin-Shue
*Attorney, Agent, or Firm*—Flynn, Thiel, Boutell & Tanis, P.C.

[57] ABSTRACT

There is provided a foothold comprising a tread, side portions positioned at both sides of the tread, legs to be inserted into a concrete wall, said tread, side portions and legs being formed of a core and first and second synthetic resins for covering the core, said second synthetic resins for covering the core of the legs having a substantially circular shape in cross section, and the first and second synthetic resins being integrated with each other, a plurality of fins provided axially on outer peripheries of the synthetic resins in a plurality of stages in the direction from the legs toward the side portions, and contact support pieces protruded from boundaries between the side portions and legs so as to bring into contact with the concrete wall. The contact support pieces can be reliably fitted to the wall surface to reliably prevent the foothold from hanging down, and the plurality of fins provided on the legs are reliably and easily fitted to the holed defined in the wall surface to reliably fix the foothold to the manhole wall, thereby providing the foothold capable of enduring for a long period of use.

8 Claims, 5 Drawing Sheets

FOOTHOLD

BACKGROUND THE INVENTION

1. Field of the Invention

The present invention relates to a foothold comprising a tread, side portions positioned at both sides of the tread and legs to be inserted into a concrete wall.

2. Prior Art

As a conventional foothold comprising a tread, side portions positioned at both sides of the tread and legs to be inserted into a concrete wall, there is known a foothold, for example, as disclosed in Japanese Utility Model Laid-Open Publication 6-71899 having the construction that fall-out prevention members are provided at portions close to the tip ends of the legs and the tip ends of the legs are pointed while collars are provided at the portions close to the centers of the legs.

In the conventional foothold, there is a possibility of producing a gap between holes defined in a concrete wall into which legs of a foothold are inserted and fall-out prevention members provided at portions close to the legs owing to the long period of use of the foothold, causing a drawback that the foothold is rattled vertically and laterally in the holes and it lacks in stability. Further, although the conventional foothold includes collars at boundaries between side portions and legs to bring into contact with the concrete wall, these collars can not sufficiently support the tread of the foothold, which causes a problem that the foothold hangs down when a load is applied to the tread.

SUMMARY OF THE INVENTION

The present invention has been made in view of the problem of the prior art. It is an object of the present invention to provide a foothold capable of reliably and easily fitting the legs of the foothold to the holes defined in the manhole and so forth so that the foothold can be reliably fixed to the manhole wall and so forth and it can endure for a long period of use.

To achieve the above object, the foothold according to the first aspect of the present invention is characterized in comprising a tread 2, side portions 3 positioned at both sides of the tread 2, legs 4 to be inserted into a concrete wall, said tread 2, side portions 3 and legs 4 being formed of a core 5 and first and second synthetic resins 6 and 6*a* for covering the core 5, said second synthetic resins 6*a* for covering the core 5 of the legs 4 having a substantially circular shape in cross section, and the first and second synthetic resins 6 and 6*a* being integrated with each other, a plurality of fins 8 provided axially on outer peripheries of the synthetic resins 6*a* in a plurality of stages in the direction from the legs 4 toward the side portions 3, and contact support pieces 9 protruded from boundaries between the side portions 3 and legs 4 so as to bring into contact with the concrete wall.

The foothold according to the second aspect of the present invention is characterized in that the upper surface of the tread 2 is inclined upward from the central portion toward the both ends thereof at the angle of 1 to 5 degrees.

The foothold according to the third aspect of the present invention is characterized in that reflectors are provided on the tread 2 at portions adjacent both ends thereof, wherein the light reflector is red and the other reflector is green.

The foothold according to the fourth aspect of the present invention is characterized in that the tread 2 has a wave-shaped grip portion provided at the inner side surface thereof in the axial direction and another wave-shaped grip portion provided at the lower surface of the tread 2 in the axial direction and having irregularities thereon.

The foothold according to the fifth aspect of the present invention is characterized in further comprising belt-shaped projections 22 formed along the outer ends of both side portions 3.

The foothold according to the sixth aspect of the present invention is characterized in further comprising rise portions 24 directed upward from both ends of the tread 2, said rise portion having side portions provided on upper ends of the rise portions 24.

The foothold according to the seventh aspect of the present invention is characterized in further comprising blow receiving portions 26 at the front side of the tread 2 when the legs 4 are embedded into the concrete wall.

The foothold according to the eighth aspect of the present invention is characterized in comprising a tread 2, side portions 3 positioned at both sides of the tread 2, legs 4 to be inserted into a concrete wall, said tread 2, side portions 3 and legs 4 being formed of a core 5, first and second synthetic resins 6 and 6*a* for covering the core 5, said second synthetic resins 6*a* for covering the core 5 of the legs 4 having a substantially circular shape in cross section, and the first and second synthetic resins 6 and 6*a* being integrated with each other, a plurality of fins 8 provided axially on outer peripheries of the synthetic resins 6*a* in a plurality of stages in the direction from the legs 4 toward the side portions 3, characterized in that the upper surface of the tread 2 is inclined upward from the central portion toward the both ends thereof at the angle of 1 to 5 degrees, and reflectors are provided on the tread 2 at portions adjacent both ends thereof, wherein the right reflector is red and the left reflector is green, while the tread 2 has a wave-shaped grip portion provided at the inner side surface thereof in the axial direction and another wave-shaped grip portion provided at the lower surface of the tread 2 in the axial direction and having irregularities thereon, and also has belt-shaped projections 22 formed along the outer ends of both side portions 3 and blow receiving portions 26 provided at the front side of the tread 2 when the legs 4 are embedded into the concrete wall, and contact support pieces 9 protruded from boundaries between the side portions 3 and legs 4 so as to bring into contact with the concrete wall.

The foothold according to the ninth aspect of the present invention is characterized in comprising a tread 2, side portions 3 positioned at both sides of the tread 2, legs 4 to be inserted into a concrete wall, said tread 2, side portions 3 and legs 4 being formed of a core 5, first and second synthetic resins 6 and 6*a* for covering the core 5, said second synthetic resins 6*a* for covering the core 5 of the legs 4 having a substantially circular shape in cross section, and the first and second synthetic resins 6 and 6*a* being integrated with each other, a plurality of fins 8 provided axially on outer peripheries of the synthetic resins 6*a* in a plurality of stages in the direction from the legs 4 toward the side portions 3, characterized in that rise portions 24 directed upward from both ends of the tread 2 and having side portions on upper ends thereof are formed, the upper surface of the tread 2 is inclined upward from the central portion toward the both ends thereof at the angle of 1 to 5 degrees, and reflectors are provided on the tread 2 at portions adjacent both ends thereof, wherein the right reflector is red and the left reflector is green, while the tread 2 has a wave-shaped grip portion provided at the inner side surface thereof in the axial direction and another wave-shaped grip portion provided at the lower surface of the tread 2 in the axial direction and having irregularities thereon, and also has blow receiving portions 26 provided at the front side of the tread 2 or at the front side of rise portion when the legs 4 are embedded into the concrete wall, and contact support pieces 9 protruded from boundaries between the side portions 3 and legs 4 so as to bring into contact with the concrete wall.

PREFERRED EMBODIMENT OF THE INVENTION

First Embodiment (FIGS. 1 to 6)

Figure 1:
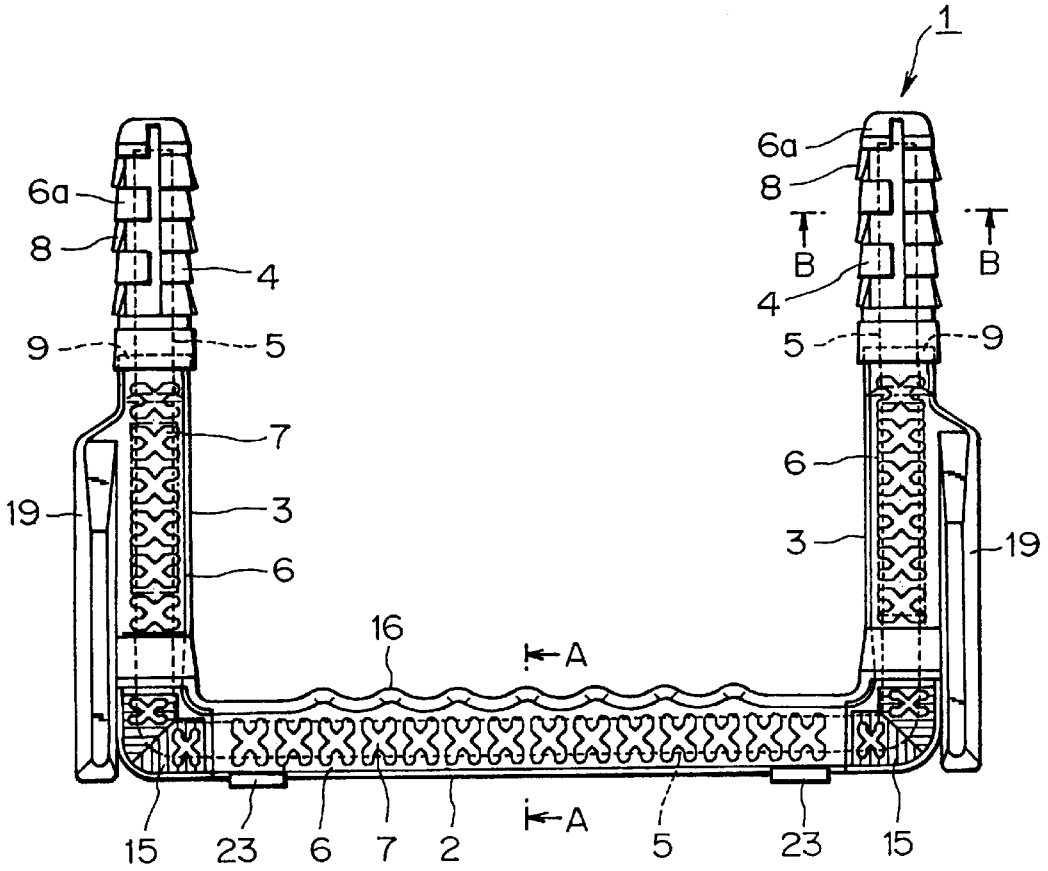
FIG. 1 is a plan view of a foothold according to a first embodiment of the present invention.
Figure 2:
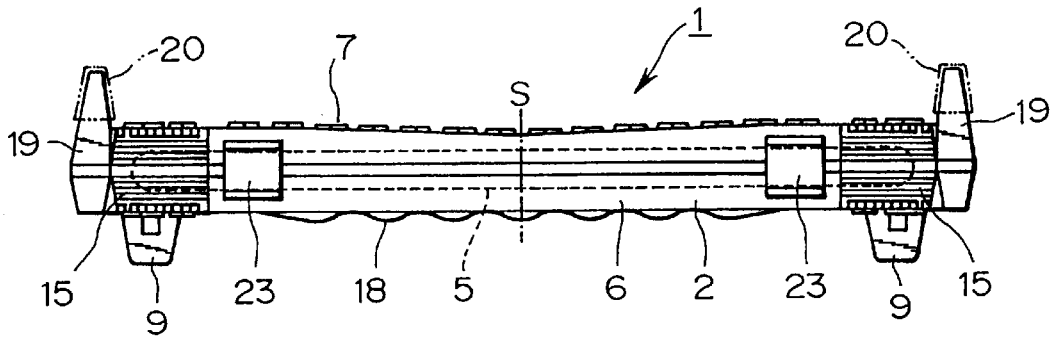
FIG. 2 is a front view of the foothold in FIG. 1.
Figure 3:
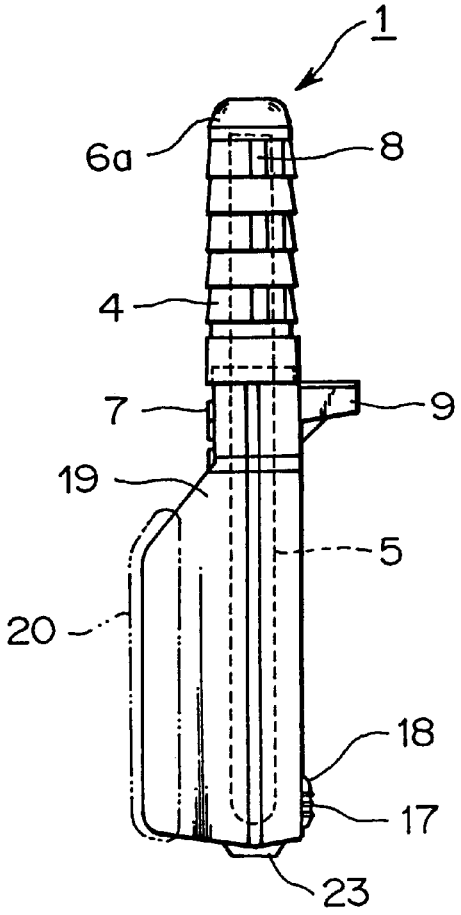
FIG. 3 is a side view of the foothold in FIG. 1.
Figure 4:
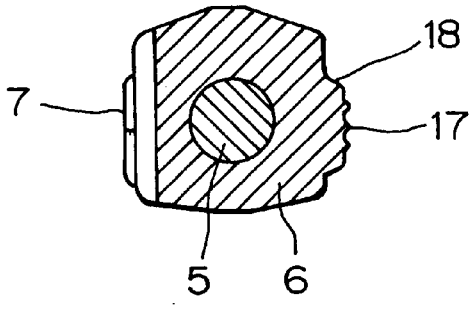
FIG. 4 is an enlarged sectional view of the foothold taken along line A—A in FIG. 1.
Figure 5:
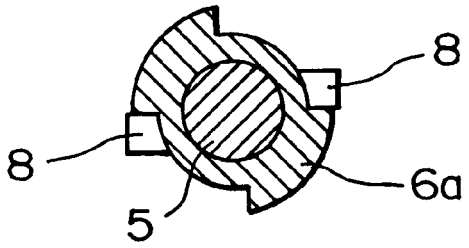
FIG. 5 is an enlarged sectional view of the foothold taken along line B—B in FIG. 1.
Figure 6:
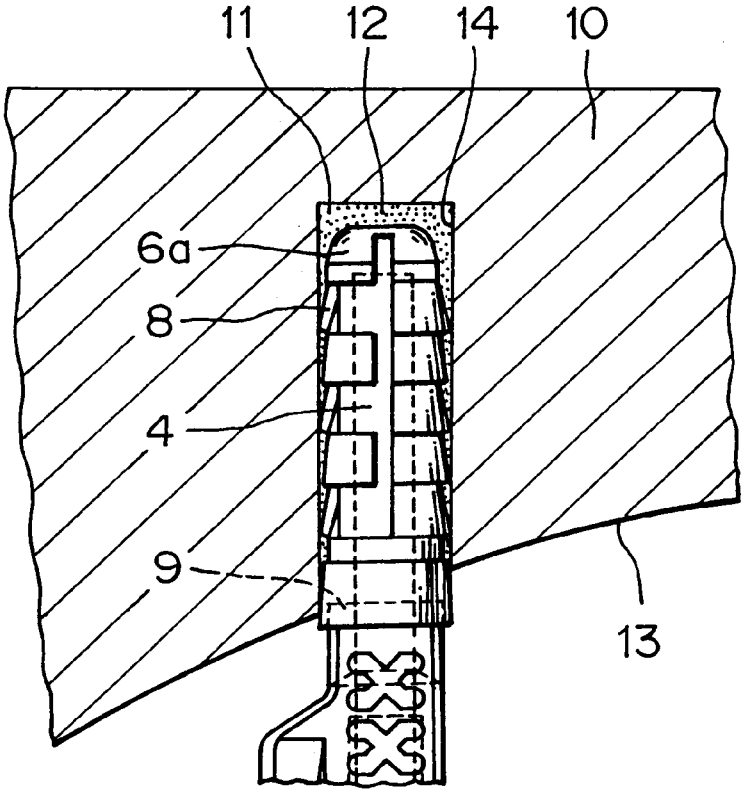
FIG. 6 is a plan view of a main portion of a foothold which is fixed to a manhole inner wall and so forth.

A foothold according to a first embodiment of the invention is described with reference to FIGS. 1 to 6, wherein FIG. 1 is a plan view of a foothold, FIG. 2 is a front view thereof, FIG. 3 is a side view thereof, FIG. 4 is an enlarged sectional view of the foothold taken along line A—A in FIG. 1, FIG. 5 is an enlarged sectional view of the foothold taken along line B—B in FIG. 1, and FIG. 6 is a plan view of a main portion of a foothold which is fixed to a manhole inner wall and so forth.

In FIG. 1, a reference numeral 1 depicts an entire configuration of a foothold. The foothold 1 comprises a tread 2, side portions 3 positioned at both sides of the tread 2, and legs 4 fixed to a concrete wall and so forth. These tread 2, side portions 3 and legs 4 are formed of a core 5 made of iron and having substantially U-shape as viewed from the plane and first synthetic resins 6 such a polypropylene cover the core 5 for keeping the core 5 from rusting. Slip prevention patterns 7 are formed on the entire surfaces of the tread 2 and side portions 3.

Second synthetic resins 6*a* covering the core 5 of the legs 4 has a substantially circular shape in cross section and a plurality of (e.g., two) fins 8 are provided axially on the outer peripheries of the second synthetic resins 6*a* in a plurality of (e.g., three) stages in the direction from the legs 4 side toward the side portions 3, wherein the fins 8 are integrated with the second synthetic resins 6*a*. Tip ends of the fins 8 are slightly curved so as to expand its diameter outward.

Denoted by 9 are contact support pieces protruded from boundaries between the side portions 3 and the legs 4 so as to bring into contact with the concrete wall surface.

In the foothold 1 having the construction set forth above, the legs 4 are inserted into holes 14 defined in an inner wall 11 of a manhole in a state where the tip ends of the fins 8 are pressed by inner hole walls 14 of holes 11 after filling epoxy resins 12 and so forth in the holes 11 of the inner wall 10, while the contact support pieces 9 protruded from the boundaries between the side portions 3 and the legs 4 are brought into contact with the manhole wall surface 13. Subsequently, the entire foothold 1 is slightly pulled toward a person. As a result, the tip ends of the fins 8 are retained relative to the inner hole walls 14 of the holes 11 while they are expanded in diameter so that the lateral rattling of the legs 4 can be reliably prevented while interlocked with the epoxy resins 12 and so forth. Further, the contact support pieces 9 are brought into contact with the manhole wall surface 13 to support the foothold 1 so that the foothold 1 is more reliably prevented from hanging down. With these operations, the legs 4 are air tightly brought into contact with the inner wall 10, and hence the legs 4 can be reliably fixed to the inner wall 10 (see FIG. 6).

The upper surface of the tread 2 is varied in the manner that it is inclined upward from the center S toward both ends thereof at the angle of 1 to 5 degrees. As a result, both feet of a person can be placed on the tread 2 with safety so that the working can be safely performed by the person.

Reflectors 15 are provided on both end corners of the tread 2. If the right reflector 15 is red while the left reflector 18 is green, the right and left positions of the foothold are made clear, thereby orienting the foothold in a specific direction.

A wave-shaped grip portion 16 is provided on the tread 2 at the inner side thereof in the axial direction thereof. Another wave-shaped grip portion 18 having irregularities 17 is formed on the tread 2 at the lower surface thereof.

In this case, although it is normally conceived that the person goes up and down the foothold 1 while gripping the foothold 1 that is positioned several stages above the foothold 1 on which the person places his or her both legs, the tread 2 can be easily gripped because the wave shape is formed on the inner side of the tread 2 in the axial direction. Still further, since the tread 2 has the wave-shaped grip portion 18 having the irregularities 17 on the lower surface of the tread 2 in the axial direction, both hands can be prevented from slipping so that the person can go up and down the foothold 1 with safety.

Denoted by 19 are belt-shaped projections formed along the outer end portions of the side portions 3. With the provision of these projections 19, even if both legs are placed on the side portions 3 when working, the working can be performed by the person with safety while both legs are not slipped laterally from the tread 2 owing to the projections 19.

It is possible to cover the back surfaces of the projections 19 by reflectors 20, as shown by imaginary lines in FIGS. 2 and 3, whereby the areas of the reflectors increase so that the position of the foothold 1 is made clearer.

Figure 7:
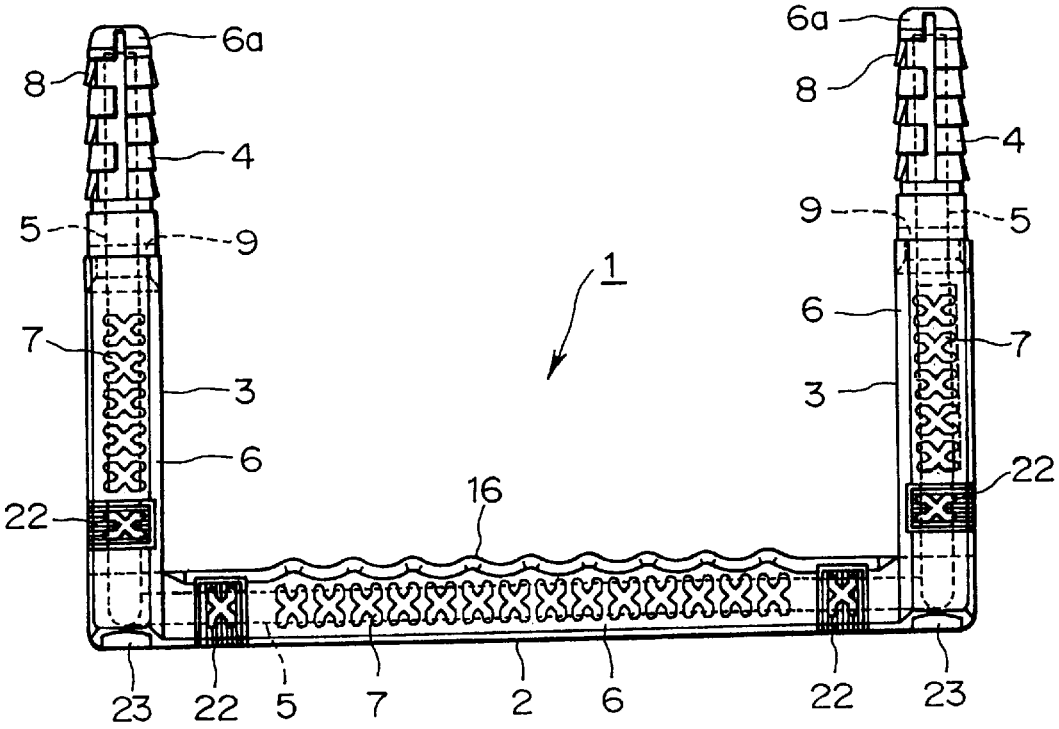
FIG. 7 is a plan view of a foothold according to a second embodiment of the present invention.
Figure 8:
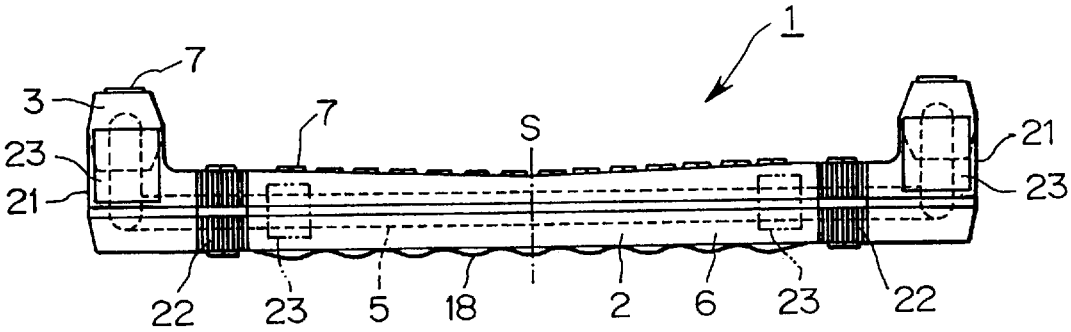
FIG. 8 is a front view of the foothold in FIG. 7.
Figure 9:
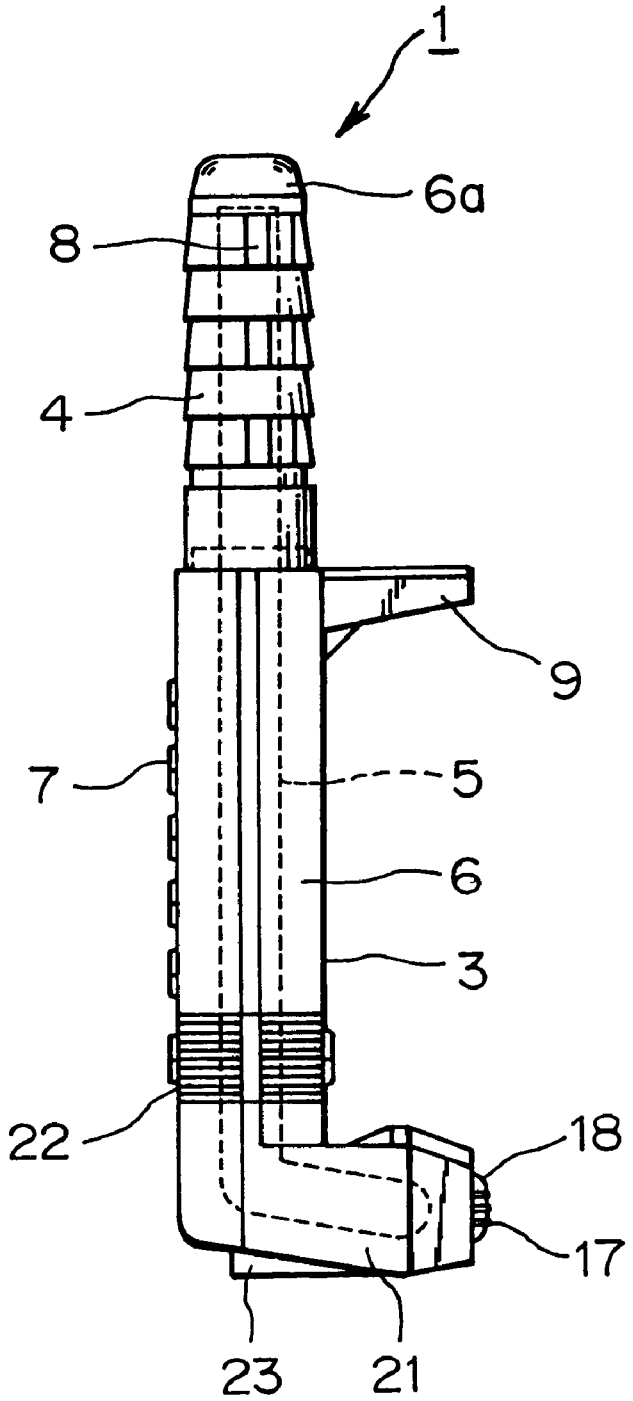
FIG. 9 is a side view of the foothold in FIG. 7.

Second Embodiment (FIGS. 7 to 9)

A foothold according to a second embodiment of the invention is described with reference to FIGS. 7 to 9. FIG. 7 is a plan view of the foothold, FIG. 8 is a front view thereof and FIG. 9 is a side view thereof.

In these figures, rise portions 21 are formed on both ends of the tread 2 while the former is directed upward from the latter. Side portions 3 are formed on the upper ends of the respective rise portions 21. Reflectors 22 are provided on portions adjacent both ends of the tread 2 and the portion adjacent the rise portions 21 of the side portions 3. Since other components of the foothold 1 of the second embodiment are substantially the same as those of the first embodiment, they are denoted by the same reference numerals, and hence the explanation thereof is omitted.

In the foothold 1 having the construction set forth above, even if both legs are placed on both ends of the tread 2 when using the foothold 1, both legs are prevented from laterally slipping by the rise portions 21, thereby providing a safe foothold.

At least one blow receiving portion 23 that is used when embedding the foothold 1 formed of synthetic resins in the concrete wall is provided on the front sides of the rise portions 21, and the blow receiving portion 23 is integrally formed with the first synthetic resins 6 of the tread 2 at the rise portions 21.

There is a case where the legs 4 are hardly embedded or inserted into the inner wall of a concrete wall even if the foothold 1 is pressed against the inner wall by hands when fixing the foothold 1 to the concrete wall. In this case, it is normally conceivable that the front side of the tread 2 is blown by a hammer and so forth to embed or insert the legs 4 in the inner wall. With the provision of the blow receiving portions 23, the front side of the tread 2 is hardly damaged, and hence the foothold 1 can be reliably fixed to the concrete wall. Further, as shown by an imaginary line of FIG. 8, two blow receiving portions 23 may be formed on the front side of the tread 2 or one blow receiving portion 23 may be formed on the central front side of the tread 2 if the width of the tread is narrow.

According to the foothold of the first aspect of the invention, since the foothold comprises a tread, side portions positioned at both sides of the tread, legs to be inserted into a concrete wall, said tread, side portions and legs being formed of a core and first and second synthetic resins for covering the core, said second synthetic resins 6*a* for covering the core of the legs having a substantially circular shape in cross section, and the first and second synthetic resins being integrated with each other, a plurality of fins provided axially on outer peripheries of the synthetic resins in a plurality of stages in the direction from the legs toward the side portions, and contact support pieces protruded from boundaries between the side portions and legs so as to bring into contact with the concrete wall, the contact support pieces can be reliably fitted to the wall surface to reliably prevent the foothold from hanging down, and the plurality of fins provided on the legs are reliably and easily fitted to the holed defined in the wall surface to reliably fix the foothold to the manhole wall, thereby providing the foothold capable of enduring for a long period of use.

According to the foothold of the second aspect of the invention, since the upper surface of the tread is inclined upward from the central portion toward the both ends thereof at the angle of 1 to degrees, both legs of a person can be placed on the upper surface of the tread with safety, and hence the person can reliably perform working.

According to the foothold of the third aspect of the invention, since reflectors are provided on both cornered portions of the tread wherein the right reflector is red and the other reflector is green, the positions of the right and left portions of the foothold are made clear, thereby providing a safe foothold capable of orienting the foothold in specific direction.

According to the foothold of the fourth aspect of the invention, since the tread has a wave-shaped grip portion provided at the inner side surface thereof in the axial direction and another wave-shaped grip portion provided at the lower surface of the tread in the axial direction having irregularities thereon, a person can easily grip the tread when going up and down the tread, and both hands are prevented from slipping from the tread, thereby providing a safe foothold.

According to the foothold of the fifth aspect of the invention, since the foothold comprises belt-shaped projections formed along the outer ends of both side portions, both legs are not laterally slipped from the tread owing to the projections, thereby providing a safe foothold capable of working with safety.

According to the foothold of the sixth aspect of the invention, since the foothold comprises rise portions directed upward from both ends of the tread, and the rise portions have side portions provided on upper ends of the rise portions, even if both legs are placed on both ends of the tread when using the foothold, both legs are not laterally slipped from the tread owing to the rise portions, thereby providing a safe foothold.

According to the foothold of the seventh aspect of the invention, since the foothold comprises blow receiving portions at the front side of the tread when the legs are embedded in the concrete wall, the foothold is hardly damaged, when it is fixed to the concrete wall, thereby providing a foothold capable of being reliably fixed to the concrete wall.

According to the foothold of the eighth and ninth aspects of the invention, since the foothold comprises all the components as set forth in the first to seventh aspects of the invention, the contact support pieces can be reliably fitted to the wall surface to reliably prevent the foothold from hanging down, and the plurality of fins provided on the legs are reliably and easily fitted to the holes defined in the wall surface to reliably fix the foothold to the manhole wall. Further, both legs are not laterally slipped from the tread owing to the projections or rise portions even if both legs are placed on side portions when using the foothold, thereby assuring the reliable working by the person. Still further, the foothold is oriented in the specific direction and the tread can be easily gripped by hands of the person when going up and down the tread, and the foothold is hardly damaged. More still further, the foothold can be reliably fixed to the wall surface, and it can endure for a long period of use.

What is claimed is:

1. A foothold comprising an elongate, foot-supporting tread, side portions positioned at both ends of the tread and extending rearwardly transverse to the tread, each said side portion having a leg cantilevered therefrom, said legs being adapted to be inserted into a wall, said tread, side portions and legs being formed of a rigid core covered by first and second synthetic resin, said second synthetic resin covering the core of the legs and having a substantially circular shape in cross section, and the first and second synthetic resins being integrated with each other, a plurality of fins provided on outer peripheries of the synthetic resins in a plurality of axially-spaced stages in the axial direction from the legs toward the side portions, an upper surface of the tread being inclined upward from a central portion toward both ends thereof at an angle of 1 to 5 degrees, reflectors provided on the tread at portions adjacent both ends thereof, wherein a first said reflector on one end of the tread is one color and a second said reflector on the other end of the tread is another color, the tread having a wave-shaped grip portion provided at an inner, rearward side surface of the tread between said side portions and extending in the axial direction of said tread, another wave-shaped grip portion provided at the lower surface of the tread and extending in the axial direction of said tread, said another wave-shaped grip portion having irregularities thereon, belt-shaped projections formed along the outer sides of both side portions for assisting in preventing a foot from sliding off an end of said tread, blow receiving portions provided at a front side of the tread when the legs are embedded in the wall so as to be disposed in an inserted position, said blow receiving portions being adapted to receive blows that will drive said legs into a wall, and contact support pieces projecting from boundaries between the side portions and legs and contacting the wall in the inserted position.

2. A foothold according to claim 1, wherein said first reflector has an L-shape and defines a corner transitioning said tread into the respective said side portion, said first reflector reflects light from portions of upper and lower surfaces of said tread and side portion, a portion of the front surface of said tread, and a portion of an outer side surface of said side portion.

3. A foothold according to claim 1, wherein said first reflector includes a first reflector member disposed on said tread adjacent said one end thereof which reflects light from upper, front, and lower surfaces of said tread, and a second reflector member disposed on said side portion adjacent said one end of said tread which reflects light from the upper, outer side, and lower surfaces of said side portion.

4. A foothold according to claim 1, wherein said one color is green and said another color is red, so that all footholds mounted in a manhole have the same orientation with said red reflectors vertically aligned with one another.

5. A foothold comprising an elongate, foot-supporting tread, side portions cantilevered from respective ends of the tread, a pair of legs cantilevered from the respective said side portions, said legs being adapted to be inserted into a wall, said tread, side portions and legs being formed of a core covered with first and second synthetic resins, said second synthetic resin covering the core of the legs and having a substantially circular shape in cross section, and the first and second synthetic resins being integrated with each other, a plurality of fins provided on outer peripheries of the synthetic resins in a plurality of axially spaced stages in the axial direction from the legs toward the side portions, raised portions directed upward from both ends of the tread and extending upwardly from the upper surface of said side portions, the upper surface of the tread being inclined upward from a central portion thereof toward the both ends thereof at an angle of 1 to 5 degrees, reflectors provided on the tread at portions adjacent both ends thereof, a right said reflector is one color and a left said reflector is another color, a wave-shaped grip portion provided at an inner side surface of the tread in the axial direction of tread between said side portions, another wave-shaped grip portion provided at a lower surface of the tread in the axial direction of tread and having irregularities thereon, blow receiving portions provided on one of a front side of the tread which face away from the legs and a front side of said raised portion when the legs are embedded in the wall so as to be in an inserted position, and contact support pieces which protrude from boundaries between the side portions and legs and contact the wall in the inserted position.

6. A foothold according to claim 5, wherein said first reflector has an L-shape and defines a corner transitioning said tread into the respective said side portion, said first reflector reflects light from portions of upper and lower surfaces of said tread and side portion, a portion of the front surface of said tread, and a portion of an outer side surface of said side portion.

7. A foothold according to claim 5, wherein said first reflector includes a first reflector member disposed on said tread adjacent said one end thereof which reflects light from upper, front, and lower surfaces of said tread, and a second reflector member disposed on said side portion adjacent said one end of said tread which reflects light from upper, outer side, and lower surfaces of said side portion.

8. A foothold according to claim 5, wherein said one color is green and said another color is red, so that all footholds mounted in a manhole have the same orientation with said red reflectors vertically aligned with one another.

* * * * *